US012025363B2

(12) United States Patent
Wang et al.

(10) Patent No.: US 12,025,363 B2
(45) Date of Patent: Jul. 2, 2024

(54) REFRIGERATOR PREVENTING AIR SUPPLY DUCT FROM FALLING DOWN

(71) Applicants: QINGDAO HAIER REFRIGERATOR CO., LTD., Shandong (CN); HAIER SMART HOME CO., LTD., Shandong (CN)

(72) Inventors: Jing Wang, Qingdao (CN); Hao Zhang, Qingdao (CN); Shengyuan Nie, Qingdao (CN); Shufei Ren, Qingdao (CN); Fa Zhao, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 363 days.

(21) Appl. No.: 17/434,387

(22) PCT Filed: Feb. 19, 2020

(86) PCT No.: PCT/CN2020/075885
§ 371 (c)(1),
(2) Date: Aug. 26, 2021

(87) PCT Pub. No.: WO2020/173358
PCT Pub. Date: Sep. 3, 2020

(65) Prior Publication Data

US 2022/0146182 A1 May 12, 2022

(30) Foreign Application Priority Data

Feb. 26, 2019 (CN) ..... 201910142771.7

(51) Int. Cl.
*F25D 17/06* (2006.01)
*F25D 11/02* (2006.01)
*F25D 23/06* (2006.01)

(52) U.S. Cl.
CPC ..... *F25D 17/065* (2013.01); *F25D 11/02* (2013.01); *F25D 23/066* (2013.01); *F25D 2317/0651* (2013.01); *F25D 2317/067* (2013.01)

(58) Field of Classification Search
CPC ..... F25D 17/065; F25D 11/02; F25D 23/066; F25D 2317/0651; F25D 2317/067;
(Continued)

(56) References Cited

U.S. PATENT DOCUMENTS 3,027,735 A 4/1962 Preotle et al.
5,996,366 A 12/1999 Renard
(Continued)

FOREIGN PATENT DOCUMENTS

CN 2550700 Y 5/2003
CN 107883643 A 4/2018
(Continued)

OTHER PUBLICATIONS

International Search Report for PCT/CN2020/075885 dated Apr. 22, 2020 with English translation (5 pages).
(Continued)

*Primary Examiner* — Ana M Vazquez
(74) *Attorney, Agent, or Firm* — Alston & Bird LLP

(57) ABSTRACT

Disclosed is a refrigerator (100) preventing an air supply duct (141) from falling down, which includes a top cover (103) that divides a lowermost storage liner (130) into a storage space (132) located above and a cooling space located below, an evaporator (101) arranged in the cooling space, and the air supply duct (141) arranged at an inner side of a rear wall of the storage liner (130). The top cover (103) includes a top cover body (103*a*) and a supporting portion (103*b*) protruding upward from a rear end of the top cover body (103*a*); a bearing portion (141*b*) protruding forward is
(Continued)

formed on a front wall surface of the air supply duct (141); and the top cover (103) and the air supply duct (141) are arranged such that the supporting portion (103*b*) supports the bearing portion (141*b*) to prevent the air supply duct (141) from falling down.

19 Claims, 7 Drawing Sheets

(58) Field of Classification Search
CPC ..... F25D 17/062; F25D 2317/0665; F25D 11/022; F25D 17/045; F25D 17/08; F25D 19/00; F25D 21/14; F25D 2317/063
See application file for complete search history.

(56) References Cited

U.S. PATENT DOCUMENTS

| | | | | |
|---|---|---|---|---|
| 2010/0125365 | A1 | 5/2010 | Ahn et al. | |
| 2019/0032989 | A1* | 1/2019 | Kim | F25B 13/00 |

FOREIGN PATENT DOCUMENTS

| | | | |
|---|---|---|---|
| CN | 109237860 | A | 1/2019 |
| CN | 208475771 | U | 2/2019 |
| CN | 110579071 | A | 12/2019 |
| CN | 209893756 | U | 1/2020 |
| CN | 210141734 | U | 3/2020 |
| EP | 3685110 | A1 | 7/2020 |
| EP | 3929511 | A1 | 12/2021 |
| FR | 2736252 | A1 | 1/1997 |
| JP | H0325271 | A | 2/1991 |
| WO | WO 2020/173361 | A1 | 9/2020 |
| WO | WO 2020/173362 | A1 | 9/2020 |
| WO | WO 2021/047548 | A1 | 3/2021 |

OTHER PUBLICATIONS

Written Opinion of the International Searching Authority for PCT/CN2020/075885 dated Apr. 22, 2020 with English translation (5 pages).
Supplementary European Search Report for EP Application No. 20763380.1 dated Mar. 22, 2022 (4 pages).
1st Office Action for European Application No. 20763380.1 dated Apr. 4, 2022 (6 pages).
1st Australia Office Action for Australia Application No. 2020227759 dated Jun. 22, 2022 (3 pages).

* cited by examiner

REFRIGERATOR PREVENTING AIR SUPPLY DUCT FROM FALLING DOWN

TECHNICAL FIELD

The present invention relates to the technical field of household appliances, and in particular to a refrigerator preventing an air supply duct from falling down.

BACKGROUND ART

In an existing refrigerator, an evaporator is generally positioned at the rear portion of a lowermost storage space, which causes that the volume of the storage space in a front-rear direction is reduced, the depth of the storage space is limited, and it is inconvenient to accommodate the articles which are large in size and not easy to separate in the storage space.

SUMMARY OF THE INVENTION

In view of the above-mentioned problems, an objective of the present invention is to provide a refrigerator that overcomes the above-mentioned problems or at least partially solves the above-mentioned problems.

A further objective of the present invention is to improve the stability of assembling of an air supply duct.

The present invention provides a refrigerator, which includes:

a cabinet, including a lowermost storage liner;

a top cover, configured to divide the storage liner into a storage space located above and a cooling space located below;

an evaporator, arranged in the cooling space, and configured to cool airflow entering the cooling space to form cooled airflow; and an air supply duct, arranged at an inner side of a rear wall of the storage liner, communicating with the cooling space, and configured to deliver at least part of the cooled airflow into the storage space.

The top cover includes a top cover body and a supporting portion protruding upward from a rear end of the top cover body, a bearing portion protruding forward is formed on a front wall surface of the air supply duct, and the top cover and the air supply duct are arranged such that the supporting portion supports the bearing portion to prevent the air supply duct from falling down.

Optionally, the bearing portion extends obliquely downward from back to front.

An upper end surface of the supporting portion includes a first inclined section extending obliquely downward from back to front, so as to facilitate formed condensed water flowing forward and downward to the top cover body along the first inclined section.

Optionally, a front end surface of the supporting portion includes a vertical section extending vertically, and the vertical section is connected with the first inclined section through a first transition curved section to guide the condensed water to the top cover body.

Optionally, an upper surface of the top cover body includes a second inclined section extending obliquely downward from back to front, and the second inclined section is connected with the vertical section through a second transition curved section to guide the condensed water.

Optionally, the upper surface of the top cover body further includes a horizontal section extending forward from a front end of the second inclined section, and at least one water collecting trough is formed in the horizontal section to collect the condensed water flowing from the second inclined section.

Optionally, the air supply duct includes an air duct front cover plate and an air duct rear cover plate located at a rear side of the air duct front cover plate, a channel communicating with the cooling space is defined by the air duct front cover plate and the air duct rear cover plate, and the bearing portion is formed on the air duct front cover plate.

Furthermore, the air duct front cover plate and the air duct rear cover plate are fixed through a screw penetrating through a center of the air supply duct.

Optionally, the refrigerator further includes:

an air blower, located behind the evaporator, an air outlet end of the blower being connected with an air inlet end of the air supply duct, and the blower being configured to promote the cooled airflow to enter the air supply duct.

Optionally, the refrigerator further includes:

at least one return air hood, arranged at a front end of the top cover and defining the cooling space together with the top cover and a bottom wall of the storage liner.

The return air hood includes:

a return air frame body located at a front side, a first opening being formed in a front wall surface of the return air frame body, and a rear end of the return air frame body being open; and a return air rear cover, inserted into the return air frame body from the open rear end of the return air frame body, and configured to divide the first opening into a first front return air inlet located above and a second front return air inlet located below, so as to facilitate return air of the storage space flowing back into the cooling space through the first front return air inlet and the second front return air inlet.

Optionally, the return air frame body includes a first guiding inclined section extending backward and upward from an upper end of a front wall surface of the return air frame body, and a second guiding inclined section extending backward and downward from a position, near a lower end, of the front wall surface of the return air frame body.

The return air rear cover includes a third guiding inclined section extending forward and downward from back to front, a fourth guiding inclined section extending forward and downward from a lower end of the third guiding inclined section, a fifth guiding inclined section extending backward and downward from a front end of the fourth guiding inclined section and a sixth guiding inclined section extending backward and downward from a lower end of the fifth guiding inclined section.

In addition, the first guiding inclined section, the third guiding inclined section, and the fourth guiding inclined section define a first return air duct located behind the first front return air inlet, and a second opening is formed in the third guiding inclined section.

The second guiding inclined section and the sixth guiding inclined section define a second return air duct located behind the second front return air inlet.

Optionally, a junction of the fourth guiding inclined section and the fifth guiding inclined section is located directly below the first guiding inclined section, so as to facilitate the condensed water condensed on the return air frame body dripping to the junction of the fourth guiding inclined section and the fifth guiding inclined section along the first guiding inclined section, dripping to the second guiding inclined section along the fifth guiding inclined section, and then flowing to a position below the evaporator.

Optionally, the storage liner is a freezing liner, and the storage space is a freezing space.

The refrigerator further includes:

a variable-temperature liner, located directly above the storage liner, a variable-temperature space being defined in the variable-temperature liner; and a refrigerating liner, located directly above the variable-temperature liner, a refrigerating space being defined in the refrigerating liner.

In the refrigerator of the present invention, a lowermost space of the refrigerator is the cooling space, which raises a height of the storage space above the cooling space, reduces a bend-down degree of a user during an operation of taking and placing articles in the storage space, and improves use experience of the user; in addition, the top cover and the air supply duct have a special design structure, which prevents the air supply duct from falling down when being subjected to external forces, and makes installation of the air supply duct more stable, thereby ensuring a refrigerating effect in the operation process of the refrigerator.

Further, in the refrigerator of the present invention, the specially designed structure of the supporting portion and the bearing portion and the specially designed structure of the top cover body have a function of guiding and drainage, which facilitates collection of the condensed water on the top cover and facilitates in-time cleaning by the user.

Furthermore, in the refrigerator of the present invention, the two return air inlets distributed vertically are formed at the front side of the return air hood, which not only has a beautiful visual appearance, but also effectively prevents children's fingers or foreign objects from entering the cooling space; in addition, two return air regions distributed vertically can make the return air flow through the evaporator more evenly after entering the cooling space, which can avoid the problem of easy frosting on a front end surface of the evaporator to a certain extent. Not only can heat exchange efficiency be improved, but also a defrosting cycle can be prolonged, energy is saved and the efficiency is high.

Furthermore, the design structure of each inclined section of the return air frame body and the design structure of each inclined section of the return air rear cover can guide the condensed water formed on the return air hood, which facilitates drainage and can avoid producing the sound of water droplets perceivable by human ears, and the use experience of the user is enhanced.

The above, as well as other objectives, advantages, and characteristics of the present invention, will be better understood by those skilled in the art according to the following detailed description of specific embodiments of the present invention taken in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In the accompanying drawings.

DETAILED DESCRIPTION OF THE INVENTION

The present embodiment provides a refrigerator 100. The refrigerator 100 of the embodiment of the present invention will be described below with reference to FIG. 1 to FIG. 10. In the following description, the orientations or positional relationships indicated by "front", "rear", "upper", "lower", "transverse" and the like are directions based on the refrigerator 100 itself as a reference, "front" and "rear" are directions indicated in FIG. 1, and as shown in FIG. 2, "transverse" refers to a direction parallel to a width direction of the refrigerator 100.

Figure 1:
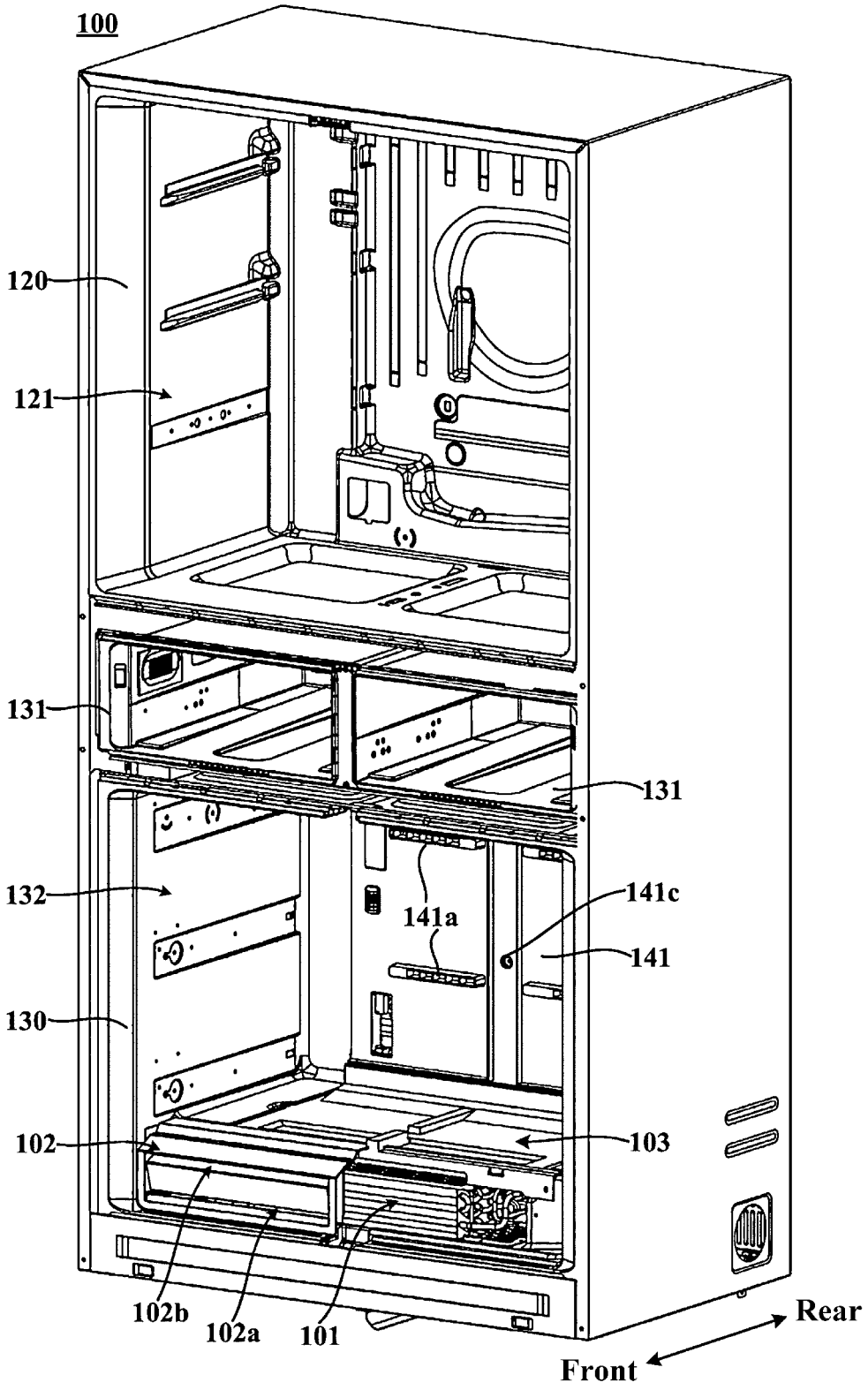
FIG. 1 is a schematic structural view of a refrigerator according to one embodiment of the present invention.
Figure 2:
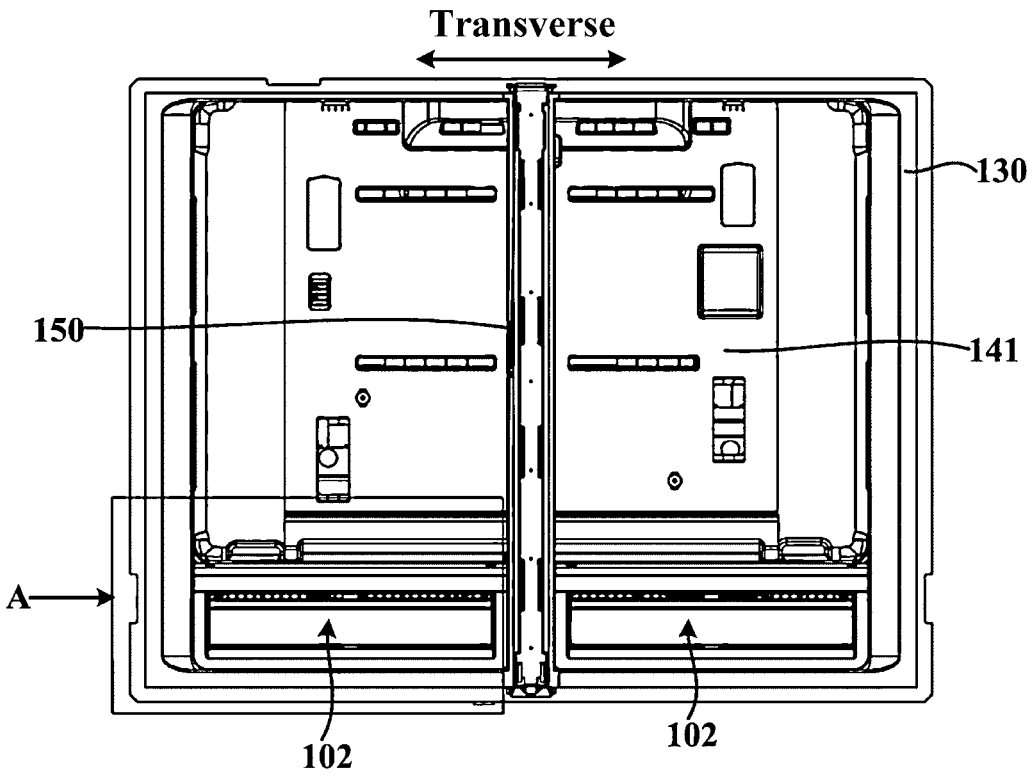
FIG. 2 is a front view of a refrigerator according to one embodiment of the present invention after a storage liner, an air supply duct, a return air hood, a top cover and other components are assembled.

As shown in FIG. 1, the refrigerator 100 may generally include a cabinet, the cabinet includes a shell and at least one storage liner arranged inside the shell; a space between the shell and the storage liner is filled with a thermal insulation material (forming a foamed layer); a storage space is defined in the storage liner; and a corresponding door body is also arranged at a front side of each storage liner to open and close the corresponding storage space.

A lowermost storage liner 130 may be a freezing liner, and correspondingly, a storage space 132 is a freezing space. As shown in FIG. 1, there are a plurality of storage liners, namely the lowermost storage liner 130, two transversely distributed variable-temperature liners 131 located directly above the storage liner 130, and a refrigerating liner 120 located directly above the two variable-temperature liners 131. A variable-temperature space is defined in each variable-temperature liner 131, and a refrigerating space 121 is defined in the refrigerating liner 120.

As is well known by those skilled in the art, a temperature in the refrigerating space 121 is generally between 2° C. and 10° C., preferably between 4° C. and 7° C. A temperature range in the freezing space is generally −22° C. to −14° C. The variable-temperature space can be adjusted to −18° C. to 8° C. at will. Optimal storage temperatures for different types of articles are different, and the suitable storage locations therefor are also different. For example, fruit and vegetable foods are suitable for being stored in the refrigerating space 121, and meat foods are suitable for being stored in the freezing space.

As can be appreciated by those skilled in the art, the refrigerator 100 of the present embodiment may further include an evaporator 101, an air blower 104, a compressor (not shown), a condenser (not shown), a throttling element (not shown) and the like. The evaporator 101 is connected with the compressor, the condenser and the throttling element through a refrigerant pipeline to form a refrigeration cycle loop. The evaporator cools down when the compressor is started, so that air passing through the evaporator is cooled.

In particular, in the present embodiment, the refrigerator 100 further includes a top cover 103 which is configured to divide the lowermost storage liner 130 into the storage space 132 located above and a cooling space located below, and the evaporator 101 is arranged in the cooling space.

In a traditional refrigerator 100, a lowermost space of the refrigerator 100 is generally a storage space. The storage space is located at a low position, a user needs to substantially bend over or squat down to take and place articles in the lowermost storage space, and it is inconvenient for the user to use, especially for the elderly to use; and, because the evaporator occupies a rear region of the lowermost storage space, a depth of the lowermost storage space is reduced. Moreover, because a compressor chamber is generally located behind the lowermost storage space, and the lowermost storage space inevitably gives way to the compressor chamber, resulting in an irregular shape of the lowermost storage space, which is inconvenient to store the articles which are large in size and not easy to separate.

In the refrigerator 100 of the present embodiment, the lowermost space of the refrigerator 100 is the cooling space, which raises a height of the storage space 132 located above the cooling space, reduces a bend-down degree of the user during the operation of taking and placing articles in the storage space 132, and improves the use experience of the user. In addition, a depth dimension of the storage space 132 is ensured, and the compressor chamber can be located below and behind the storage space 132. The storage space 132 does not need to give way to the compressor chamber, and presents a large and well-shaped rectangular space, which facilitates placing articles which are large in size and not easy to separate and solves the problem that large articles cannot be placed in the storage space 132.

The evaporator 101 cools airflow entering the cooling space to form cooled airflow. At least part of the cooled airflow is delivered to the storage space 132 through the air supply duct 141. The air supply duct 141 can be arranged at an inner side of a rear wall of the storage liner 130 and communicates with the cooling space. As shown in FIG. 1, a plurality of air supply outlets 141*a* communicating with the storage space 132 are formed in the air supply duct 141.

The refrigerator 100 further includes a variable-temperature air duct (not shown) for delivering the cooled airflow to the variable-temperature space. The variable-temperature air duct can be in communication with the air supply duct 141 in a controlled mode through a variable-temperature damper, so as to guide part of the cooled airflow in the air supply duct 141 into the variable-temperature air duct.

The refrigerator 100 may further include a refrigerating air duct (not shown) that delivers the cooled airflow to the refrigerating space. The refrigerating air duct can be in communication with the air supply duct 141 in a controlled mode through a refrigerating damper, so as to guide part of the cooled airflow of the air supply duct 141 into the refrigerating air duct. In some alternative embodiments, another evaporator may be arranged in the refrigerating liner 120 to cool the refrigerating space 121 in a mode of air cooling or direct cooling, so as to form the refrigerator 100 with dual refrigeration systems to prevent tainting by other odor between the storage space 132 and the refrigerating space 121.

Figure 3:
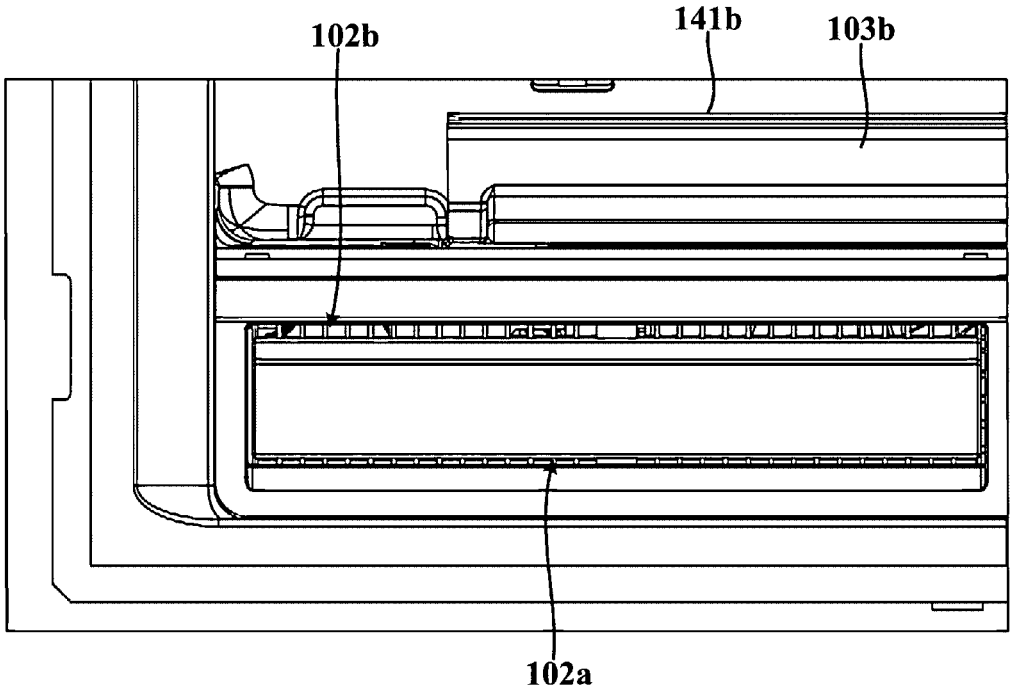
FIG. 3 is an enlarged view of a region A in FIG. 2.
Figure 4:
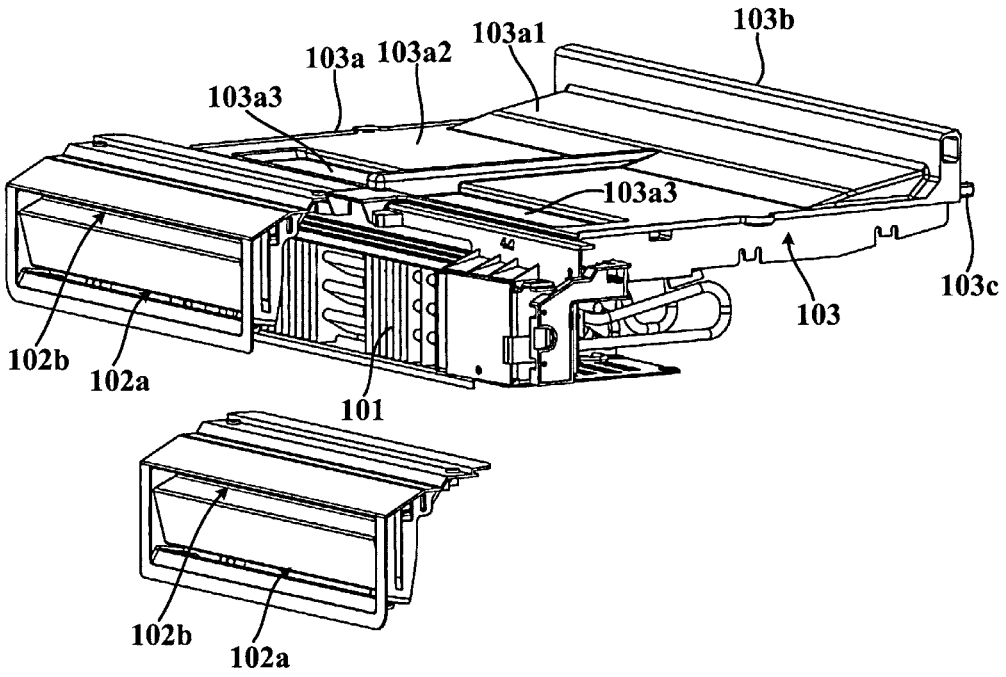
FIG. 4 is a first schematic partial exploded view of a refrigerator according to one embodiment of the present invention.

More specifically, as shown in FIG. 4 and in conjunction with what is shown in FIG. 3, the top cover 103 includes a top cover body 103*a* and a supporting portion 103*b* protruding upward from a rear end of the top cover body 103*a*, and a bearing portion 141*b* protruding forward is formed on a front wall surface of the air supply duct 141. When the top cover 103 and the air supply duct 141 are assembled, the supporting portion 103*b* supports the bearing portion 141*b* to prevent the air supply duct 141 from falling down when the refrigerator 100 is collided during transportation.

Figure 5:
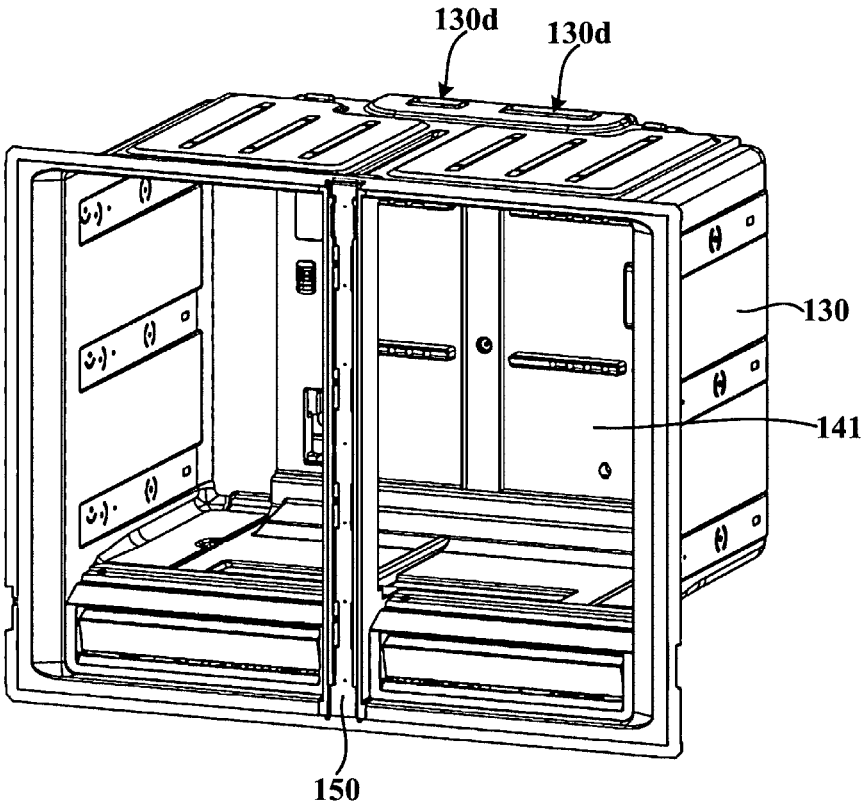
FIG. 5 is a schematic stereoscopic view of a refrigerator according to one embodiment of the present invention after a storage liner, an air supply duct, a return air hood, a top cover and other components are assembled.
Figure 7:
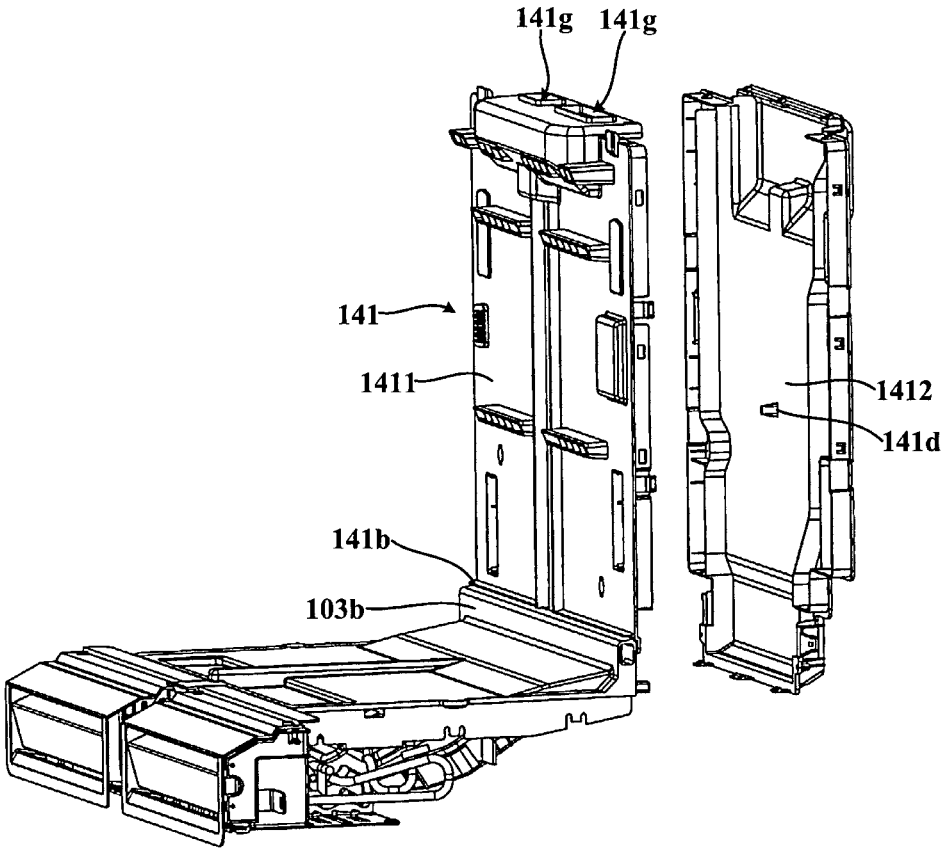
FIG. 7 is a second schematic partial exploded view of a refrigerator according to one embodiment of the present invention.

A top end of the air supply duct 141 usually penetrates through a top wall of the storage liner 130 to communicate with air ducts that supply air to other storage spaces (for example, the variable-temperature air duct (not shown) that supplies air to the variable-temperature space above the lowermost storage liner 130). Specifically, as shown in FIG. 5 and FIG. 7, first top openings 141*g* are formed in the top end of the air supply duct 141, and second top openings 130*d* in one-to-one correspondence with the first top openings 141*g* are formed in a top wall of the storage liner 130, so as to communicate the first top opening 141*g* with an air inlet of a variable-temperature chamber air duct through the second top opening 130*d*.

A damper can be arranged at the first top opening 141*g* of the air supply duct 141 to open and close the first top opening 141*g* in a controlled mode. As shown in FIG. 1, there are two variable-temperature liners 131, and correspondingly, there are two variable-temperature chamber air ducts, and both the numbers of the first top openings 141*g* and the second top openings 130*d* are two.

The refrigerator 100 will inevitably be collided during the transportation process, which will easily cause the air supply duct 141 to fall down. Once the air supply duct 141 falls down, there will be a gap between the first top opening in the top end of the air supply duct 141 and the corresponding second top opening in the top wall of the storage liner 130. During the operation of the refrigerator 100, there will be air mixing between the variable-temperature space and the storage space 132 therebelow, which affects the temperatures of the storage space 132 and the variable-temperature space, and is likely to cause frosting near the top end of the air supply duct 141, thus delivering of the cooled airflow is affected, and a refrigerating effect is lowered.

In the present embodiment, by specially designing the top cover 103 and the air supply duct 141 as described above, the air supply duct 141 can be prevented from falling down when being subjected to external forces, so that installation of the air supply duct 141 is more stable, thereby ensuring the refrigerating effect during the operation of the refrigerator 100.

Figure 6:
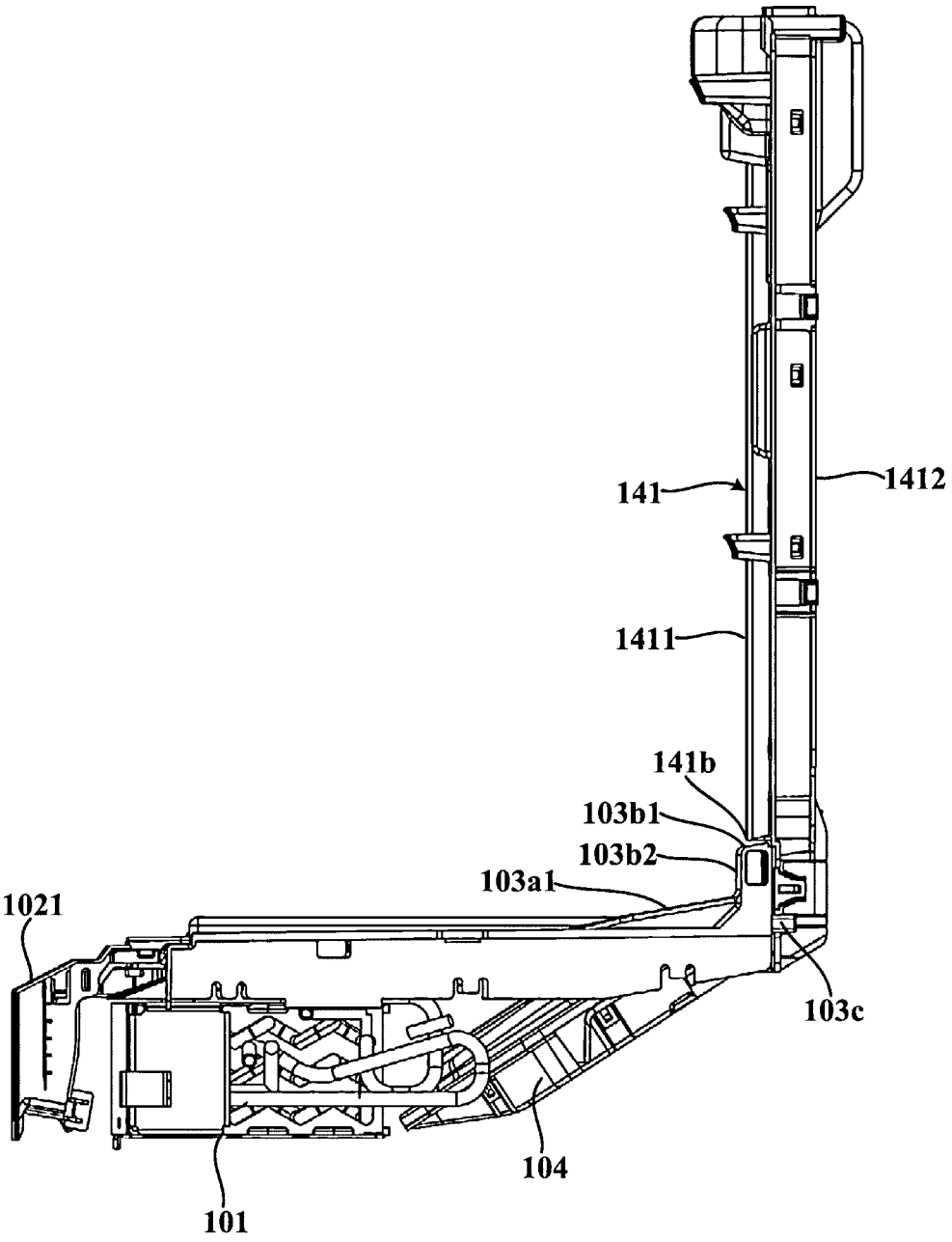
FIG. 6 is a side view of a refrigerator according to one embodiment of the present invention after an air supply duct, a return air hood, a top cover, an evaporator and an air blower are assembled.

As shown in FIG. 6, in conjunction with what is shown in FIG. 1, the air supply duct 141 includes an air duct front cover plate 1411 and an air duct rear cover plate 1412 located at a rear side of the air duct front cover plate 1411; correspondingly, the air duct front cover plate 1411 forms a front wall surface of the air supply duct 141, that is, the bearing portion 141*b* is formed on the air duct front cover plate 1411; and a channel communicating with the cooling space is defined by the air duct front cover plate 1411 and the air duct rear cover plate 1412.

The air duct front cover plate 1411 and the air duct rear cover plate 1412 are fixed through a screw (not shown) penetrating through a center of the air supply duct 141. As shown in FIG. 1, a screw pass-through hole 141*c* is formed at an approximate center position of the air duct front cover plate 1411. As shown in FIG. 7, a screw post 141*d* is formed at an approximate center position of the air duct rear cover plate 1412, and the air duct front cover plate 1411 and the air duct rear cover plate 1412 are fitted and locked with the screw post 141*d* through the screw passing through the screw pass-through hole 141*c*. In this way, the air duct front cover plate 1411 and the air duct rear cover plate 1412 are assembled together. The aforementioned specially designed structure to prevent the air supply duct 141 from falling down simultaneously avoids the problem that when the screw is loosened, the air duct front cover plate 1411 moves downward.

More specifically, the bearing portion 141*b* extends obliquely downward from back to front, and an upper end surface of the supporting portion 103*b* includes a first inclined section 103*b*1 extending obliquely downward from back to front, and condensed water can flow forward and downward to the top cover body 103*a* along an inclined surface of the bearing portion 141*b* and an inclined surface of the first inclined section 103*b*1.

A front end surface of the supporting portion 103*b* may include a vertical section 103*b*2 extending vertically, the vertical section 103*b*2 is connected with the first inclined section 103*b*1 through a first transition curved section, and the vertical section 103*b*2 guides the condensed water that slides off along the first inclined section 103*b*1 to the top cover body 103*a*.

An upper surface of the top cover body 103*a* may include a second inclined section 103*a*1 extending obliquely downward from back to front, and the second inclined section 103*a*1 is connected with the vertical section 103*b*2 through a second transition curved section to further guide the condensed water.

The upper surface of the top cover body 103*a* may further include a horizontal section 103*a*2 extending forward from a front end of the second inclined section 103*a*1, and at least one water collecting trough 103*a*3 is formed in the horizontal section 103*a*2 to collect the condensed water flowing from the second inclined section 103*a*1, which facilitates concentrated cleaning of the condensed water by the user. By this, the function of guiding and drainage is achieved by the special structure of the top cover 103. As shown in FIG. 4, two water collecting troughs 103*a*3 spaced transversely are formed in the horizontal section 103*a*2.

In some embodiments, as shown in FIG. 6, the air blower 104 is located behind the evaporator 101, and an air outlet end of the air blower is connected with an air inlet end of the air supply duct 141, and the air blower is configured to promote the cooled airflow to enter the air supply duct 141 to accelerate airflow circulation and increase the refrigerating speed.

The air blower 104 can be a centrifugal fan, an axial fan or a cross-flow fan. As shown in FIG. 6, in the present embodiment, the air blower 104 is a centrifugal fan. The air blower 104 is arranged obliquely upward from front to back. The air blower 104 is detachably connected with the air supply duct 141. When the refrigerator 100 is assembled, the air duct rear cover plate 1412 is first assembled with the air blower 104, then the air duct front cover plate 1411 is assembled with the air blower 104, and then the top cover 103 is installed on the storage liner 130. The positions of the air duct rear cover plate 1412, the air duct front cover plate 1411 and the top cover 103 satisfy that the supporting portion 103*b* of the top cover 103 supports the bearing portion of the air duct front cover plate 1411.

As shown in FIG. 4 and FIG. 6, positioning protrusions 103*c* protruding backward are formed at a rear end of the top cover 103, positioning grooves (not shown) in one-to-one correspondence with the positioning protrusions 103*c* are formed in a rear wall of the storage liner 130. There may be two positioning protrusions 103*c*, the two positioning protrusions 103*c* are close to two transverse sides of the rear end of the top cover 103 respectively and are both located below the supporting portion 103*b*. By this, the top cover 103 is assembled on the storage liner 130.

As shown in FIG. 1 to FIG. 4, the refrigerator 100 further includes at least one return air hood 102, the return air hood is arranged at a front end of the top cover 103, and defines the aforementioned cooling space jointly with the top cover 103 and a bottom wall of the storage liner 130.

Each return air hood 102 includes a return air frame body 1021 located at a front side and a return air rear cover 1022. A first opening 102*c* is formed in a front wall surface of the return air frame body 1021, and a rear end of the return air frame body is open. The return air rear cover 1022 is inserted into the return air frame body 1021 from the open rear end of the return air frame body 1021, and is arranged to divide the first opening 102*c* into a first front return air inlet 102*b* located above and a second front return air inlet 102*a* located below, so as to facilitate return air of the storage space 132 flowing back into the cooling space through the first front return air inlet 102*b* and the second front return air inlet 102*a*, to be cooled by the evaporator 101; thus, airflow circulation is formed between the storage space 132 and the cooling space.

In the present embodiment, the two return air inlets distributed vertically (the first front return air inlet 102*b* and the second front return air inlet 102*a*) are formed in the front side of the return air hood 102, which not only has a beautiful visual appearance, but also effectively prevents children's fingers or foreign objects from entering the cooling space; in addition, two return air regions distributed vertically can make the return air flow through the evaporator 101 more evenly after entering the cooling space, which can avoid the problem of easy frosting on a front end surface of the evaporator 101 to a certain extent. Not only can heat exchange efficiency be improved, but also a defrosting cycle can be prolonged, energy is saved and the efficiency is high.

As shown in FIG. 2 and FIG. 5, there are two return air hoods 102, and the two return air hoods 102 are spaced transversely. A vertical beam 150 is arranged between the two return air hoods 102, and the vertical beam 150 extends vertically upward to a top wall of the storage liner 130 to separate the front side of the storage liner 130 into two transversely distributed regions.

The front side of the storage liner 130 may be provided with two side-by-side door bodies (not shown), and the two door bodies are used for opening and closing the two regions separated by the vertical beam 150 respectively.

Figure 8:
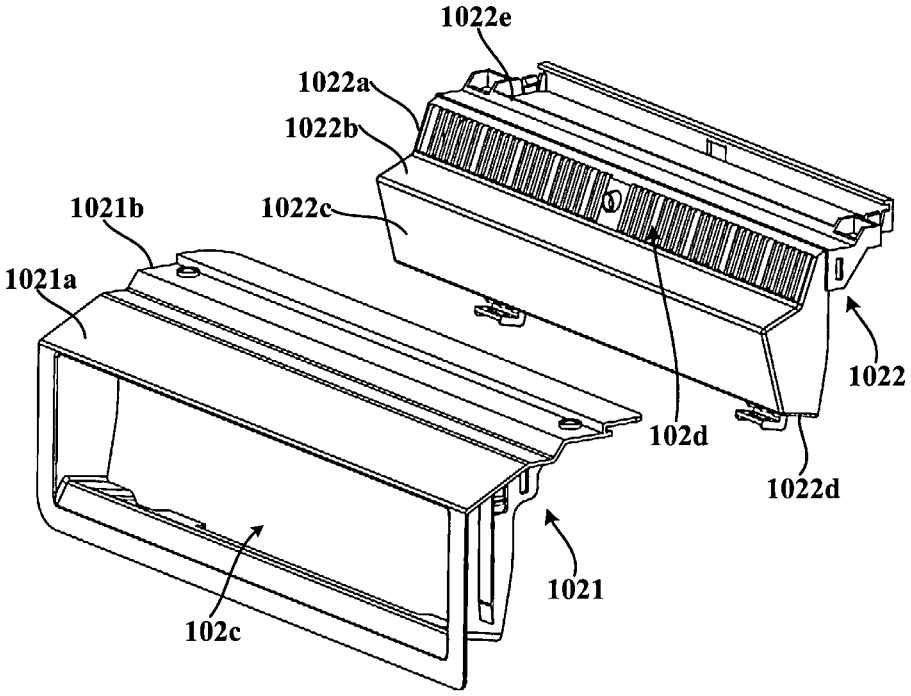
FIG. 8 is a schematic exploded view of a return air frame body and a return air rear cover of a refrigerator according to one embodiment of the present invention.
Figure 9:
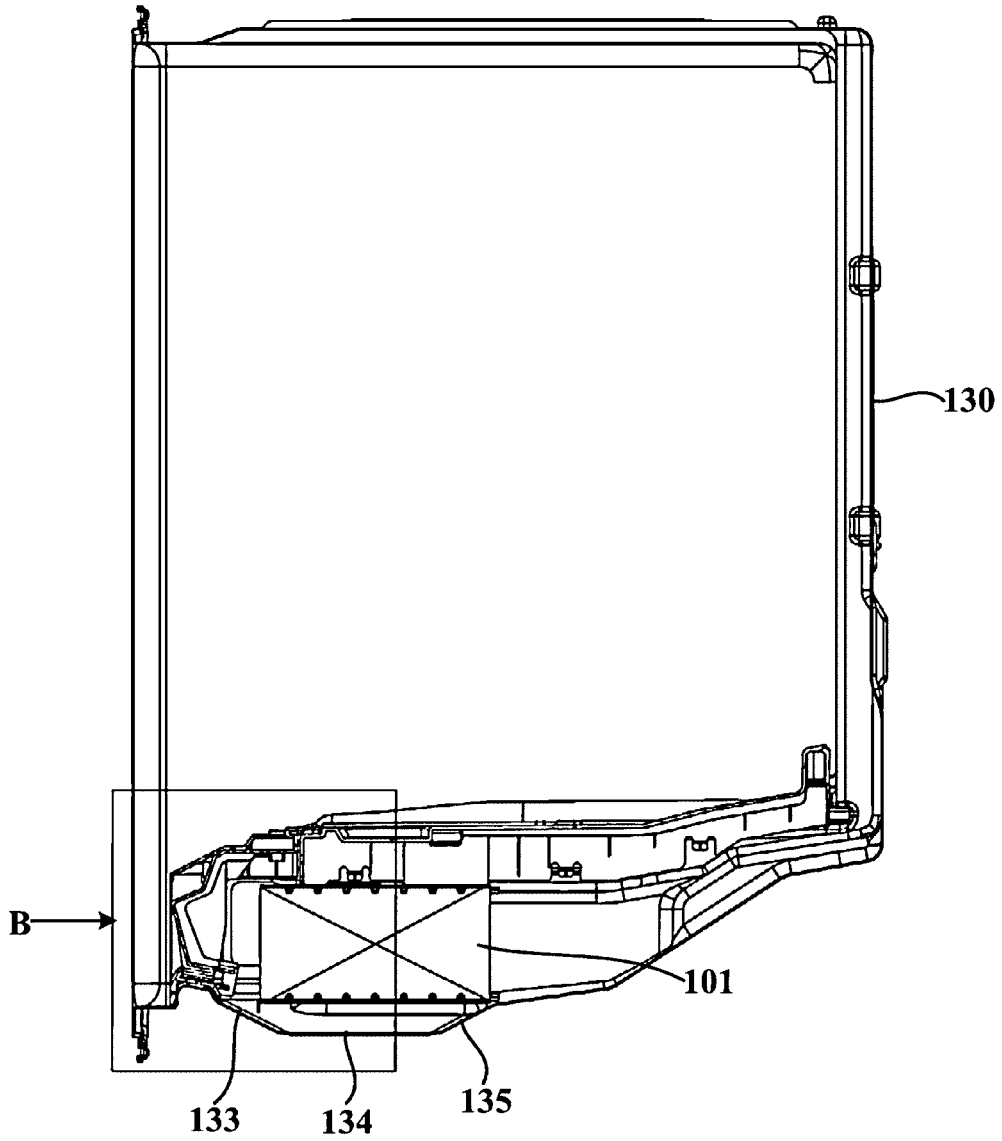
FIG. 9 is a partial cross-sectional view of a refrigerator according to one embodiment of the present invention.
Figure 10:
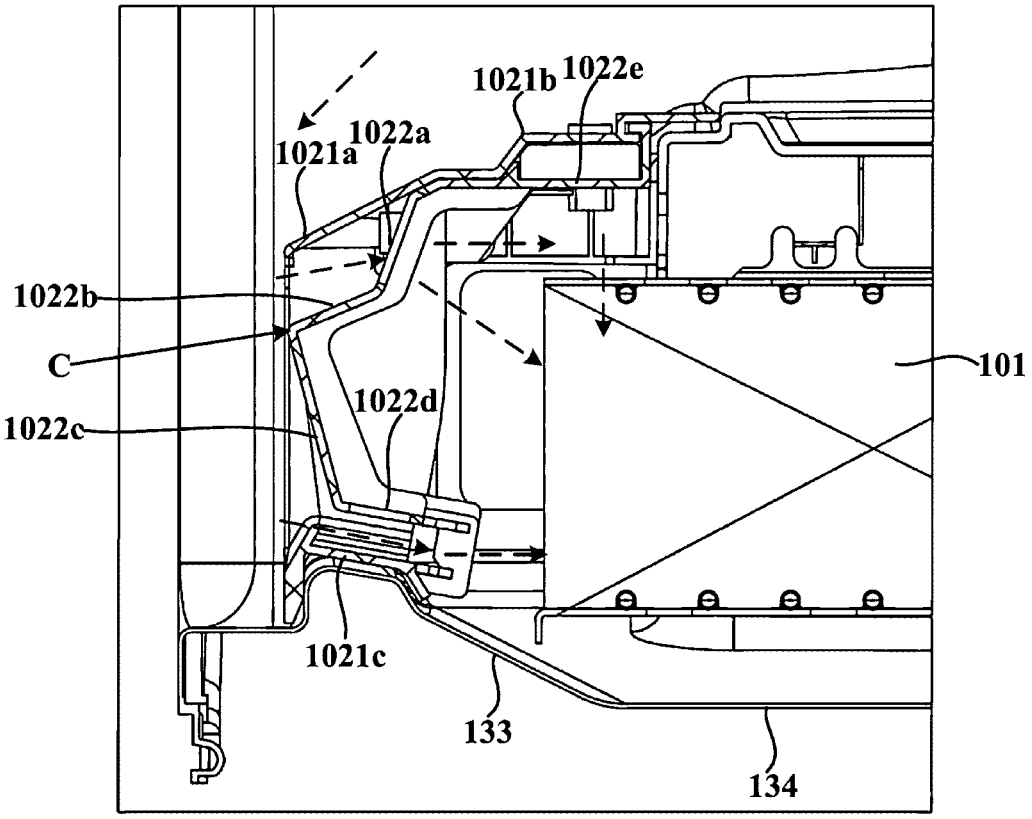
FIG. 10 is an enlarged view of a region B in FIG. 9.

More specifically, as shown in FIG. 8 to FIG. 10, the return air frame body 1021 includes a first guiding inclined section 1021*a* extending backward and upward from an upper end of a front wall surface of the return air frame body 1021, and a second guiding inclined section 1021*c* extending backward and downward from a position, near a lower end, of the front wall surface of the return air frame body 1021; the return air rear cover 1022 includes a third guiding inclined section 1022*a* extending forward and downward from back to front, a fourth guiding inclined section 1022*b* extending forward and downward from a lower end of the third guiding inclined section 1022*a*, a fifth guiding inclined section 1022*c* extending backward and downward from a front end of the fourth guiding inclined section 1022*b* and a sixth guiding inclined section 1022*d* extending backward and downward from a lower end of the fifth guiding inclined section 1022*c*.

Referring to FIG. 10, the first guiding inclined section 1021*a*, the third guiding inclined section 1022*a*, and the fourth guiding inclined section 1022*b* define a first return air duct (not labeled) located behind the first front return air inlet 102*b*, and second openings 102*d* are formed in the third guiding inclined section 1022*a*. Return air entering from the first front return air inlet 102*b* enters the cooling space through the first return air duct and the second openings 102*d*, and enters the evaporator 101 from an upper section of the evaporator 101 to exchange heat with the evaporator 101. The second guiding inclined section 1021*c* and the sixth guiding inclined section 1022*d* define a second return air duct (nor labeled) located behind the second front return air inlet 102*a*. Return air entering from the second front return air inlet 102*a* enters the cooling space through the second return air duct, and enters the evaporator 101 from a lower section of the evaporator 101 to exchange heat with the evaporator 101.

As shown in FIG. 10, the dashed arrow in FIG. 10 schematically represents a return air flow path. The return air enters the cooling space through the two upper and lower return air ducts, so that the return air passes through the evaporator 101 more evenly, and the heat exchange efficiency is improved. In addition, design of each inclined section of the return air frame body 1021 and design of each inclined section of the return air rear cover 1022 guide the condensed water condensed on the return air hood 102, which facilitates drainage.

As shown in FIG. 8, each second opening 102*d* is in a shape of a vertical strip, and the plurality of second openings 102*d* are sequentially distributed in the transverse direction to disperse the return air, so that the return air enters the upper section of the evaporator 101 more evenly.

A plurality of third openings (not shown) sequentially distributed in the transverse direction may be formed in the sixth guiding inclined section 1022*d*, and return air passing through a second return air channel is diverted by the respective third openings and then enters the cooling space, so that the return air enters the lower section of the evaporator 101 more evenly.

Mounting portions (not labeled) may be formed on the sixth guiding inclined section 1022*d*. As shown in FIG. 8, two mounting portions spaced transversely are formed on the sixth guiding inclined section 1022*d*, and correspondingly, matching portions that cooperate with the corresponding mounting portions are formed on the second guiding inclined section 1021*c* of the return air frame body 1021 to assemble the return air frame body 1021 and the return air rear cover 1022.

As shown in FIG. 4 and referring to FIG. 8 and FIG. 10, a lower surface of the top cover 103 is spaced apart from an upper surface of the evaporator 101, and the front end of the top cover 103 is located above and behind a front end of the evaporator 101, that is to say, the top cover 103 does not completely cover the upper surface of the evaporator 101, and a front section of the upper surface of the evaporator 101 is not covered by the top cover 103.

The return air rear cover 1022 further includes a shielding portion (denoted as a first shielding portion 1022*e*) extending backward and upward from the third guiding inclined section 1022*a* to the front end of the top cover 103, the first shielding portion 1022*e* is arranged to shield the section, that is not shielded by the top cover 103, of the upper surface of the evaporator 101, and the first shielding portion 1022*e* is spaced from the upper surface of the evaporator 101 to form an airflow bypass channel that communicates with the second openings 102*d*, and at least part of return air entering through the second openings 102*d* can enter the evaporator 101 from an upper portion of the evaporator 101 via the airflow bypass channel.

A directly opposite space between the top cover 103 and the upper surface of the evaporator 101 is filled with windshield foam, that is, a rear part of the airflow bypass channel is filled with windshield foam, so that all of the return air passing through the airflow bypass channel flows into the evaporator 101. By this, it ensures that even when the front end surface of the evaporator 101 is frosted, there is still return air entering the evaporator 101 to exchange heat with the evaporator, thereby ensuring the refrigerating effect of the evaporator 101, and solving the problem of the existing refrigerator 100 that due to the frosting on the front end surface of the evaporator 101, the refrigerating effect is lowered, and the refrigerating performance of the refrigerator 100 is improved.

As shown in FIG. 8 and FIG. 10, the return air frame body 1021 further includes a second shielding portion 1021*b* bending and extending backward and upward from the first guiding inclined section 1021*a* to the top cover 103. The second shielding portion 1021*b* completely shields the first shielding portion 1022*e* to keep an appearance of the return air hood 102 beautiful.

More specifically, referring to FIG. 10, a junction C of the fourth guiding inclined section 1022*b* and the fifth guiding inclined section 1022*c* is located directly below the first guiding inclined section 1021*a*, and the condensed water formed on the return air frame body 1021 just drips down to the junction C of the fourth guiding inclined section 1022*b* and the fifth guiding inclined section 1022*c* (that is, a corner position between the fourth guiding inclined section 1022*b* and the fifth guiding inclined section 1022*c*) directly below the first guiding inclined section along an inclined surface of the first guiding inclined section 1021*a*, then drips onto the second guiding inclined section 1021*c* along an inclined surface of the fifth guiding inclined section 1022*c*, and then flows to a position below the evaporator 101. Generally, a water receiving region is formed below the evaporator 101, and a drain port is formed in the water receiving region to discharge the condensed water. By this, the condensed water formed on the return air hood 102 is guided and discharged so as to avoid the sound of water droplets perceivable by human ears, and improve the use experience of the user.

A water receiving section below the evaporator 101 may be formed in a bottom wall of the storage liner 130, and a projection of the water receiving section on a vertical plane parallel to a side wall of the storage liner 130 includes a front guiding inclined section 133 located at a front side and extending backward and downward, a horizontal straight section 134 extending horizontally backward from the front guiding inclined section 133, and a rear guiding inclined section 135 extending backward and upward from a rear end of the horizontal straight section 134, and a drain port (not shown) is formed in the horizontal straight section 134. The condensed water formed on the return air hood 102 is guided by the respective inclined sections of the return air frame body 1021 and the return air rear cover 1022, flows to the horizontal straight section 134 along the front guiding inclined section 133, and is finally discharged by the drain port. The condensed water on the evaporator 101 flows to the horizontal straight section 134 along the front guiding inclined section 133 and the rear guiding inclined section 135 respectively, and is discharged from the drain port.

The drain port is connected with a drain pipe (not shown), and the condensed water is guided to an evaporating dish of the refrigerator 100 through the drain pipe. The evaporating dish can generally be located in the compressor chamber to utilize heat of the condenser and/or the compressor arranged in the compressor chamber to evaporate water in the evaporating dish.

Hereto, those skilled in the art should realize that although multiple exemplary embodiments of the present invention have been shown and described in detail herein, without departing from the spirit and scope of the present invention, many other variations or modifications that conform to the principles of the present invention can still be directly determined or deduced from contents disclosed in the present invention. Therefore, the scope of the present invention should be understood and recognized as covering all these other variations or modifications.

The invention claimed is:

1. A refrigerator, comprising:

a cabinet, comprising a lowermost storage liner;

a top cover, configured to divide the storage liner into a storage space located above and a cooling space located below;

an evaporator, arranged in the cooling space, and configured to cool airflow entering the cooling space to form cooled airflow; and an air supply duct, arranged at an inner side of a rear wall of the storage liner, communicating with the cooling space, and configured to deliver at least part of the cooled airflow into the storage space;

wherein the top cover comprises a top cover body and a supporting portion extending and protruding upward from a rear end of the top cover body without a lower end of the supporting portion being below the top cover body, a bearing portion protruding forward is formed on a front wall surface of the air supply duct, and the top cover and the air supply duct are arranged such that the supporting portion supports the bearing portion from below to prevent the air supply duct from falling down, wherein the bearing portion extends obliquely downward from back to front, and wherein an upper end surface of the supporting portion, supporting the bearing portion, comprises a first inclined section extending obliquely downward from back to front, so as to facilitate condensed water flowing forward and downward to the top cover body along the first inclined section.

2. The refrigerator according to claim 1, wherein a front end surface of the supporting portion comprises a vertical section extending vertically, and the vertical section is connected with the first inclined section through a first transition curved section to guide the condensed water to the top cover body.

3. The refrigerator according to claim 2, wherein an upper surface of the top cover body comprises a second inclined section extending obliquely downward from back to front, and the second inclined section is connected with the vertical section through a second transition curved section to guide the condensed water.

4. The refrigerator according to claim 3, wherein the upper surface of the top cover body further comprises a horizontal section extending forward from a front end of the second inclined section, and at least one water collecting trough is formed in the horizontal section to collect the condensed water flowing from the second inclined section.

5. The refrigerator according to claim 1, wherein the air supply duct comprises an air duct front cover plate and an air duct rear cover plate located at a rear side of the air duct front cover plate, a channel communicating with the cooling space is defined by the air duct front cover plate and the air duct rear cover plate, and the bearing portion is formed on the air duct front cover plate; and the air duct front cover plate and the air duct rear cover plate are fixed through a screw penetrating through a center of the air supply duct.

6. The refrigerator according to claim 1, further comprising:

an air blower, located behind the evaporator, wherein an air outlet end of the air blower is connected with an air inlet end of the air supply duct, and the air blower is configured to promote the cooled airflow to enter the air supply duct.

7. The refrigerator according to claim 1, further comprising:

at least one return air hood, arranged at a front end of the top cover and defining the cooling space together with the top cover and a bottom wall of the storage liner;

wherein the return air hood comprises:

a return air frame body located at a front side, wherein a first opening is formed in a front wall surface of the return air frame body, and a rear end of the return air frame body is open; and a return air rear cover, inserted into the return air frame body from the open rear end of the return air frame body, and configured to divide the first opening into a first front return air inlet located above and a second front return air inlet located below, so as to facilitate return air of the storage space flowing back into the cooling space through the first front return air inlet and the second front return air inlet.

8. The refrigerator according to claim 7, wherein the return air frame body comprises a first guiding inclined section extending backward and upward from an upper end of a front wall surface of the return air frame body, and a second guiding inclined section extending backward and downward from a position, near a lower end, of the front wall surface of the return air frame body;

the return air rear cover comprises a third guiding inclined section extending forward and downward from back to front, a fourth guiding inclined section extending forward and downward from a lower end of the third guiding inclined section, a fifth guiding inclined section extending backward and downward from a front end of the fourth guiding inclined section and a sixth guiding inclined section extending backward and downward from a lower end of the fifth guiding inclined section;

the first guiding inclined section, the third guiding inclined section, and the fourth guiding inclined section define a first return air duct located behind the first front return air inlet, and a second opening is formed in the third guiding inclined section; and the second guiding inclined section and the sixth guiding inclined section define a second return air duct located behind the second front return air inlet.

9. The refrigerator according to claim 8, wherein a junction of the fourth guiding inclined section and the fifth guiding inclined section is located directly below the first guiding inclined section, so as to facilitate the condensed water condensed on the return air frame body dripping to the junction of the fourth guiding inclined section and the fifth guiding inclined section along the first guiding inclined section, dripping to the second guiding inclined section along the fifth guiding inclined section, and then flowing to a position below the evaporator.

10. The refrigerator according to claim 1, wherein the storage liner is a freezing liner, and the storage space is a freezing space;

the refrigerator further comprises:

a variable-temperature liner, located directly above the storage liner, wherein a variable-temperature space is defined in the variable-temperature liner; and a refrigerating liner, located directly above the variable-temperature liner, wherein a refrigerating space is defined in the refrigerating liner.

11. A refrigerator, comprising:

a cabinet, comprising a lowermost storage liner;

a top cover, configured to divide the storage liner into a storage space located above and a cooling space located below;

an evaporator, arranged in the cooling space, and configured to cool airflow entering the cooling space to form cooled airflow;

an air supply duct, arranged at an inner side of a rear wall of the storage liner, communicating with the cooling space, and configured to deliver at least part of the cooled airflow into the storage space; and at least one return air hood, arranged at a front end of the top cover and defining the cooling space together with the top cover and a bottom wall of the storage liner, wherein the at least one return air hood comprises:

a return air frame body located at a front side, the return air frame body comprising:

a first guiding inclined section extending backward and upward from an upper end of a front wall surface of the return air frame body; and a second guiding inclined section extending backward and downward from a position, near a lower end, of the front wall surface of the return air frame body;

wherein a first opening is formed in a front wall surface of the return air frame body, and a rear end of the return air frame body is open; and a return air rear cover, inserted into the return air frame body from the open rear end of the return air frame body, and configured to divide the first opening into a first front return air inlet located above and a second front return air inlet located below, so as to facilitate return air of the storage space flowing back into the cooling space through the first front return air inlet and the second front return air inlet, the return air rear cover comprising:

a third guiding inclined section extending forward and downward from back to front;

a fourth guiding inclined section extending forward and downward from a lower end of the third guiding inclined section;

a fifth guiding inclined section extending backward and downward from a front end of the fourth guiding inclined section; and a sixth guiding inclined section extending backward and downward from a lower end of the fifth guiding inclined section;

wherein the first guiding inclined section, the third guiding inclined section, and the fourth guiding inclined section define a first return air duct located behind the first front return air inlet, and a second opening is formed in the third guiding inclined section, and wherein the second guiding inclined section and the sixth guiding inclined section define a second return air duct located behind the second front return air inlet, wherein the top cover comprises a top cover body and a supporting portion protruding upward from a rear end of the top cover body, a bearing portion protruding forward is formed on a front wall surface of the air supply duct, and the top cover and the air supply duct are arranged such that the supporting portion supports the bearing portion to prevent the air supply duct from falling down.

12. The refrigerator according to claim 11, wherein the bearing portion extends obliquely downward from back to front; and an upper end surface of the supporting portion comprises a first inclined section extending obliquely downward from back to front, so as to facilitate condensed water flowing forward and downward to the top cover body along the first inclined section.

13. The refrigerator according to claim 12, wherein a front end surface of the supporting portion comprises a vertical section extending vertically, and the vertical section is connected with the first inclined section through a first transition curved section to guide the condensed water to the top cover body.

14. The refrigerator according to claim 13, wherein an upper surface of the top cover body comprises a second inclined section extending obliquely downward from back to front, and the second inclined section is connected with the vertical section through a second transition curved section to guide the condensed water.

15. The refrigerator according to claim 14, wherein the upper surface of the top cover body further comprises a horizontal section extending forward from a front end of the second inclined section, and at least one water collecting trough is formed in the horizontal section to collect the condensed water flowing from the second inclined section.

16. The refrigerator according to claim 15, wherein the air supply duct comprises an air duct front cover plate and an air duct rear cover plate located at a rear side of the air duct front cover plate, a channel communicating with the cooling space is defined by the air duct front cover plate and the air duct rear cover plate, and the bearing portion is formed on the air duct front cover plate; and the air duct front cover plate and the air duct rear cover plate are fixed through a screw penetrating through a center of the air supply duct.

17. The refrigerator according to claim 11, further comprising:

an air blower, located behind the evaporator, wherein an air outlet end of the air blower is connected with an air inlet end of the air supply duct, and the air blower is configured to promote the cooled airflow to enter the air supply duct.

18. The refrigerator according to claim 11, wherein a junction of the fourth guiding inclined section and the fifth guiding inclined section is located directly below the first guiding inclined section, so as to facilitate the condensed water condensed on the return air frame body dripping to the junction of the fourth guiding inclined section and the fifth guiding inclined section along the first guiding inclined section, dripping to the second guiding inclined section along the fifth guiding inclined section, and then flowing to a position below the evaporator.

19. The refrigerator according to claim 11, wherein the storage liner is a freezing liner, and the storage space is a freezing space;

the refrigerator further comprises:

a variable-temperature liner, located directly above the storage liner, wherein a variable-temperature space is defined in the variable-temperature liner; and a refrigerating liner, located directly above the variable-temperature liner, wherein a refrigerating space is defined in the refrigerating liner.

* * * * *